United States Patent [19]

Bush et al.

[11] Patent Number: 4,801,103

[45] **Date of Patent: * Jan. 31, 1989**

[54] APPARATUS FOR PRESTRESSING CONCRETE STRUCTURES OR THE LIKE

[75] Inventors: Bill R. Bush, West Babylon; Andrew Tripp, Jr., Woodbury; Tadeusz J. Marchaj, Port Washington, all of N.Y.

[73] Assignee: Preload Concrete Structures, Inc., Garden City, N.Y.

[ * ] Notice: The portion of the term of this patent subsequent to Apr. 21, 2004 has been disclaimed.

[21] Appl. No.: 11,220

[22] Filed: Feb. 5, 1987

Related U.S. Application Data

[63] Continuation-in-part of Ser. No. 626,101, Jun. 29, 1984, Pat. No. 4,659,033, which is a continuation-in-part of Ser. No. 504,280, Jun. 14, 1983, abandoned.

[51] Int. Cl.[4] ..... B65H 59/38; B65H 81/02

[52] U.S. Cl. ..... 242/7.21; 242/128; 242/155 BW

[58] Field of Search ..... 242/7.21, 7.22, 128, 242/81, 47.08, 47.09, 47.12, 155 BW, 75.53; 254/273, 903

[56] References Cited

U.S. PATENT DOCUMENTS

| | | | |
|---|---|---|---|
| 2,520,403 | 8/1950 | Hirsh | 242/7.22 |
| 2,660,856 | 12/1953 | Kingsbury | 242/128 X |
| 2,711,291 | 6/1955 | Kennedy | 242/7.22 |
| 2,749,054 | 6/1956 | Crom | 242/7.22 |
| 2,785,866 | 3/1957 | Vogt | 242/7.21 |
| 2,797,878 | 7/1957 | Crom | 242/7.21 |
| 3,269,672 | 8/1966 | Steinback | 242/128 |
| 3,379,385 | 4/1968 | Osweiler | 242/7.22 |
| 3,687,380 | 8/1972 | Magers | 242/7.21 |
| 3,759,489 | 9/1973 | Jones | 254/273 |
| 3,770,219 | 11/1973 | Hickman | 242/7.22 |
| 3,773,270 | 11/1973 | Brandestini | 242/7.21 |
| 3,804,268 | 4/1974 | Barron et al. | 254/273 X |
| 4,659,033 | 4/1987 | Bush et al. | 242/155 BW X |

*Primary Examiner*—Stuart S. Levy
*Assistant Examiner*—Joseph J. Hail, III
*Attorney, Agent, or Firm*—Curtis, Morris & Safford

[57] ABSTRACT

Apparatus for prestressing concrete structures or the like by wrapping tensioned wire around the peripheral walls of the same includes a carriage which travels about the periphery of the structure, a device mounted on said carriage for paying off wire from a wire supply, a wire tensioning mechanism which includes at least one pair of stress wheels which the wire at least partially encircles, a tensiometer, a tensioned wire payout device which is adjustable to pay out wire at selectable heights relative to the carriage, a slip clutch linked to at least one of the stress wheels and being adjusted to slip when torque transferred from the tension in the wire is applied to the clutch and exceeds a predetermined torque value thereby allowing the tension in the wire to be controlled, and a driving motor mounted to the carriage to propel the carriage about the periphery of the structure. A monitoring system is also provided which automatically and rapidly increases or decreases the tension in the prestressed wire being applied to the concrete structure so as to keep the tension in the wire within a small tolerance of the predetermined level.

18 Claims, 10 Drawing Sheets

FIG. 5
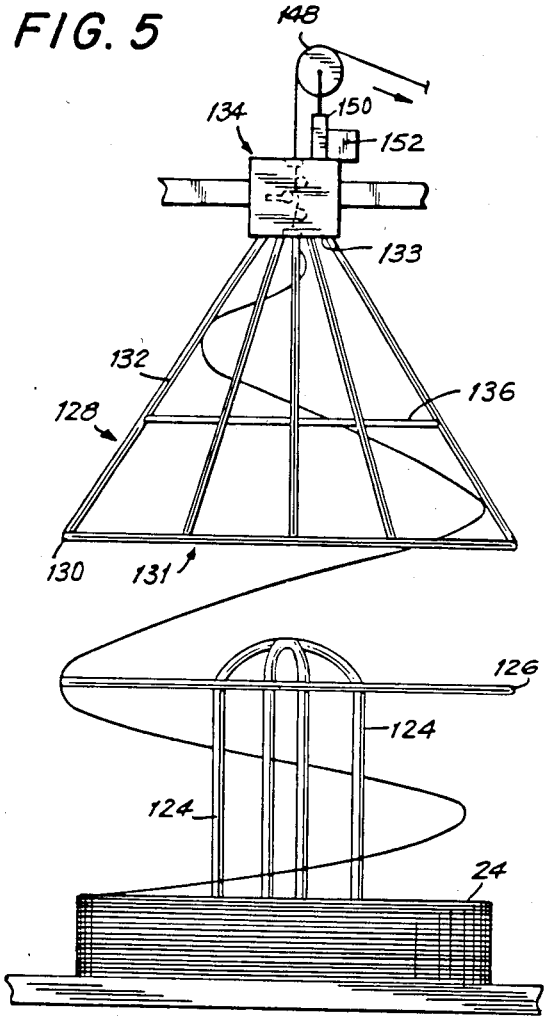
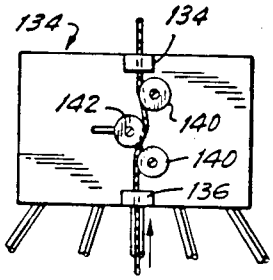
FIG. 6
FIG. 7
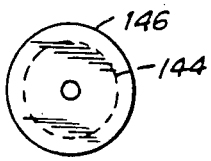
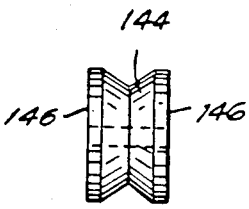
FIG. 8

APPARATUS FOR PRESTRESSING CONCRETE STRUCTURES OR THE LIKE

This is a continuation-in-part application of U.S. patent application Ser. No. 06/626,101 filed June 29, 1984 which was a continuation-in-part application of U.S. patent application Ser. No. 504,280 filed June 14, 1983, now abandoned.

BACKGROUND OF THE INVENTION

Field of the Invention

The present invention relates to a new and useful device which automatically adjusts the tension in prestressed wire used in conjunction with an apparatus for prestressing concrete structures or the like, such as reservoirs, nuclear reactor housings, pipe and pressure vessels in general.

It is a commonly used practice to wrap or bind concrete tanks with a continuous spiral of wire which maintains the wall of the tank under prestressed compression at all times regardless of variations in internal hydraulic pressure as the tank is filled or emptied. It is therefore of extreme importance that all wire to be wrapped around the tank be wrapped at a tension within a precise tolerance range.

OBJECTS AND SUMMARY OF THE INVENTION

It is an object of the present invention to provide a prestressing device which tensions wire and lays the same onto the walls of a circular or other shaped concrete structure.

A further object of the present invention is to provide a prestressing device which continuously maintains the tension in the wire as it is being wrapped around the tank.

It is a still further object of the present invention to provide a prestressing device which will lay the wire onto the wall of the concrete structure with no or negligible deformation of the wire.

It is yet another object of the present invention to describe a prestressing apparatus which can position and space the wire on the concrete structure in accordance with the particular job requirements.

It is a still further object of the present invention to provide a prestressing apparatus which expends relatively little power in wrapping the tank.

It is yet still a further object of the present invention to automatically and rapidly increase or decrease the tension in the prestressing wire being applied to the concrete structure so as to keep the tension within a small tolerance of a predetermined range.

The prestressing apparatus of the present invention basically comprises a carriage which is driven about the periphery of a concrete structure to be wrapped. The carriage is suspended from an overhead trolleys which rides on the upper rim of the structure being wrapped. The carriage has mounted thereon a drive sprocket, first and second gear boxes, a pair of stress wheels and a slip clutch. The drive sprocket meshes with a drive chain which is circumferentially placed about the concrete structure to be wrapped. The first gearbox is attached to the drive sprocket through a drive sprocket shaft. The first gearbox has an output shaft which rotates at a proportionally increased speed when compared to the rotational speed of the drive sprocket shaft. The output shaft of the first gearbox is connected to one end of the slip clutch. The other end of the slip clutch is connected to the output shaft of the second gearbox. The input shaft of the second gearbox rotates at a proportionally decreased speed compared to the rotational speed of the output shaft of the second gearbox. The input shaft of the second gearbox is driven by one of the pair of stress wheels.

The carriage may also include a wire supply, such as a wire spool, and wire supply payoff means. The wire is unwrapped from the spool, passes through the supply payoff means and is fed to the stress wheels. The wire is then wrapped around the stress wheels several times and, under tension, is paid off from the stress wheels onto the wall of the concrete structure. A tensiometer may further be included and is preferably situated above and between the stress wheels. The wire, as it travels around the stress wheels during its last wrap thereabout, contacts the tensiometer which registers the tension in the wire before it is laid on the concrete structure.

The tensiometer includes a pivot bar, a load cell, and a contact pad mounted at one end of the pivot bar which contacts the load cell. The force exerted on the load cell is proportional to the tension in the wire before it is paid off from the prestressing device onto the wall of the concrete structure being wrapped.

In accordance with one object of the present invention, an electronic device monitors the voltage signal produced by the load cell. When the desired tension in the wire is achieved, a predetermined voltage signal is indicated. The electronic device is pre-set at this voltage signal such that a monitored voltage below the predetermined voltage causes the electronic device to increase the air pressure to the slip clutch. A monitored voltage above the predetermined voltage causes a decrease in the air pressure to the slip clutch. Since the air pressure to the slip clutch is what determines the tension in the prestressing wire, the result is an automatic feedback loop which results in the wire tension constantly being monitored and brought back to the desired tension. The electronic device of the present invention includes two solenoid air pressure valves and a circuit board which controls the operation of the valves, depending on the monitored voltage signal from the load cell.

Although it is envisioned that an external driving means may be employed to propel the carriage about the periphery of the concrete structure, the carriage may have integrally mounted thereon a driving motor interconnected to the drive sprocket to supplement the driving force which propels the carriage about the concrete structure. It should be noted that the major force driving the carriage is the tension in the wire which is transferred to the drive sprocket.

The stress in the wire is produced by the difference between the distance which the prestressing device travels about the periphery of the concrete structure and the length of untensioned wire fed out from the wire supply. The stress wheels, around which the wire is wrapped and from which the wire under tension is paid out, may have smaller diameters than the drive sprocket which engages the drive chain. The stress wheels and drive sprocket may be geared together so that for each rotation of the drive sprocket, the wheels will also make one rotation. Because the length of wire which engages the two stress wheels develops enough friction to prevent slippage of the wire around the stress wheels, the wire will be elongated and thus tensioned to compensate for the distance the prestressing apparatus travels around the concrete structure.

Theoretically, the ratio of the diameters of the stress wheels to the diameter of the drive sprocket could be selected to provide the exact elongation in the wire which coincides with the desired wire stress. In practice, the ratio is very difficult to achieve because of dimension tolerances, component wearing and drive chain elongation. The stress wheels are, therefore, sized below the theoretical value so that the wire would be overstressed. The slip clutch, which is interposed between the stressing wheels and the drive sprocket, slips at a predetermined torque value based upon the desired wire stress.

The stress wheels provide surface friction to counteract the force in the stressed wire. One of the stress wheels also drives a shaft which is used to transfer the torque produced by the stress in the wire to other systems in the prestressing device. Rather than wrapping the wire around one wheel, two wheels, preferably grooved, are employed.

The two wheel configuration of the present invention has advantages over one wheel devices commonly used in the art. When a one wheel prestressing system is used, the wire tends to walk along the wheel from the point at which it exits to the point at which it enters. The wire must be forced into proper position by either adjacent wires or external guiding means. In the two wheel system, the wire naturally travels around the wheels in straight continuous grooves from entrance point to exit point. Such grooves cannot be used with a single wheel because the grooves would have to have a spiral orientation and walking of the wire would result.

In a one wheel system, the wire must be forced to travel in a desired path. This produces frictional forces which results in inconsistent tension placed on the wire. Because the wire need not be forced into a particular path in a two wheel system, a more precise and consistent stress in the wire is achieved.

Furthermore, the two wheel system of the present invention allows wire splices to pass through the system without jamming and without unraveling or damaging the wire splices. This is advantageous because the wire splices may be incorporated in the wire length before the wire is stressed.

Four main purposes are served by the present invention. First, torque is transferred from the stress wheels to the drive train, thereby resulting in lower power requirements. Second, the prestressing device of the present invention insures a consistent wire stress as a result of the continuous slip in the clutch at a predetermined torque value. Third, the present invention provides the ability to easily change the stress in the wire by adjusting the clutch to slip at any desired torque. Fourth, the present invention automatically increases or decreases the tension in the prestressing wire being applied to the concrete structure so as to keep the wire tension within a small tolerance of a predetermined level.

Prior art prestressing devices which use a slip clutch set the rotational speeds of the input and output shafts of the slip clutch equal to the rotational speeds of the stress wheel and drive sprocket, respectively. At low slip speeds, which is desirable in such prior art systems to save energy, the frictional value in the clutch elements varies between those based on the static and dynamic coefficients of friction. This affects the slip torque and results in an inconsistent tension in the wire. The prestressing device of the present invention overcomes this problem by increasing the shaft speed into and out of the slip clutch. By doing this, the frictional value in the clutch elements is maintained at its dynamic value, and thereby produces a constant stress with the same saving in energy.

In addition, increasing the rotational speed of the input and output shafts of the slip clutch decreases the torque transfer to the clutch. Such is advantageous because the size and torque capacity of the clutch may be reduced in proportion to the speed increase ratio.

As previously mentioned, the prestressing device of the present invention includes means for paying off wire from the wire supply. The wire payoff means feeds the wire from the spool to the stressing wheels and provides a constant back tension with less chance of wire entanglement and breakage. Commonly known wire payoff systems rely on a turntable or rotation bar device which allow the wire spool to rotate and thereby pay out the wire. Such a payoff system may prove to be unsatisfactory in many respects. In particular, the back tension in the wire may vary as a result of the friction between moving parts, wire entanglements, the weight of the wire above its exit point and the change in the moment of inertia as the full weight of the wire coil decreases. Providing power to a turntable on which the wire supply rests to rotate the turntable at a predetermined speed would lessen but would not eliminate the effects on the back tension as described above.

The prestressing device of the present invention does not call for the rotation of the wire supply and thus eliminates all the effects on back tension inherent in rotating wire supply systems.

The payoff means of the present invention also is advantageous over the prior art in that the back tension of the wire can be adjusted to and held constant at any predetermined value. This is achieved by adjusting a back tension wheel unit or "killer wheel" assembly which will be described in greater detail later.

Furthermore, one of the limitations on the speed at which a prestressing device can travel about the structure was the ability of the operator to monitor the wire supply payout operation. At high speeds, the monitoring becomes difficult with systems commonly known in the art because of the high rotational speed of the wire coil. Because the wire supply of the present invention remains stationary, less supervision is required and, as a result, the prestressing device can proceed around the tank at much greater speeds.

As previously mentioned, the prestressing device of the present invention may include a tensiometer. This device allows the continuous monitoring and recording of the actual stress in the wire as it is applied to the tank walls. The wire, on its last wrap around the stress wheels, contacts the tensiometer and angularly displaces a pivotable element thereof. The pivotable element acts upon a load cell which measures the contact force of the wire, which is directly proportional to the actual stress in the wire.

Commonly known tensiometers which measure wire stress through displacement techniques usually include three sheaves—two outer sheaves for angularly displacing the wire and a center sheave for measurement purposes which transfers the resultant stress to a load cell or other force measuring component.

One of the advantages of the tensiometer used in the present invention is that the two stress wheels secondarily function as outer sheaves for the tensiometer with a center sheave positioned between and slightly above or out of line with the two stress wheels. Such an arrangement is more compact and requires fewer parts. Furthermore, because the stress wheels, which act as the outer sheaves for the tensiometer, are relatively large, the tensiometer allows wire splices to easily pass through the measuring device without unraveling or damaging the splice.

The carriage may also have mounted thereon means for adjustably paying out the tensioned wire. Preferably, the adjustable payout means include a vertically disposed post which is adjustably mounted to the carriage. A horizontally disposed sheave, which is mounted either to the carriage or to the vertical post deflects the wire being paid off the last stress wheel onto a vertically disposed center sheave adjustably mounted on the vertical post. The center sheave in turn deflects the tensioned wire to either an upper or lower payoff sheave, mounted to swivel, respectively, on the upper and lower ends of the vertical post. Thus, if wire is to be laid on the tank walls at a point above the carriage, the vertical post is adjusted to a predetermined height with respect to the floor of the carriage, and the center sheave is adjusted on the post to receive the tensioned wire from the horizontal deflection sheave and to deflect the wire to the upper payoff sheave. The upper payoff sheave adjustably swivels on the upper end of the vertical post to pay off the tensioned wire at an angle tangential to the wall of the concrete structure.

The above and other objects, features and advantages of this invention will be apparent in the following detailed description of illustrative embodiments thereof, which are to be read in connection with the accompanying drawings.

BRIEF DESCRIPTION OF THE DRAWINGS

FIG. 5 is an elevational view of a wire supply payoff device in accordance with the present invention.

FIG. 6 is an expanded view in elevation of a portion of FIG. 5.

FIGS. 7 and 8 are respectively front and side detail drawings of a portion of FIG. 5.

DETAILED DESCRIPTION OF THE PREFERRED EMBODIMENTS

Figure 1:
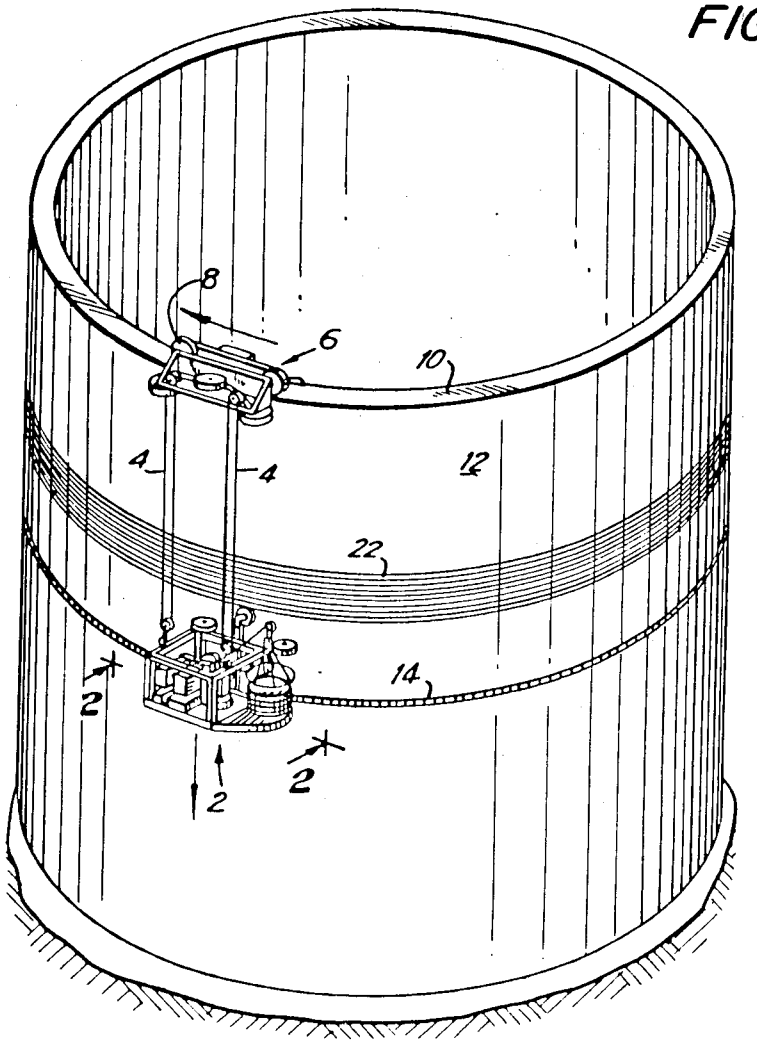
FIG. 1 is an environmental view of a prestressing device in accordance with the present invention wrapping a concrete structure with tensioned wire.

Referring now to the drawings in detail and to FIGS. 1-4 thereof, it will be seen that a prestressing apparatus constructed in accordance with the present invention includes a carriage 2 suspended by cables 4 from an overhead trolley or carriage 6 which travels on rollers 8 about the upper rim 10 of a concrete structure 12. Carriage 2 follows a drive chain 14 which is placed about the periphery of the concrete structure 12. Carriage 2 can be raised or lowered on cables 4 which pass through pulleys 16 attached to hooks 18 which in turn pass through eye bolts 20 provided on carriage 2. Tensioned wire 22 is wrapped around the periphery of the concrete structure 12 at a predetermined spacing by raising or lowering carriage 2. Although FIG. 1 shows carriage 2 suspended from an overhead carriage 6, it is also envisioned that the carriage could be supported by a framework which rides on the ground and travels about the periphery of the concrete structure. As will subsequently be described in greater detail, the prestressing device in accordance with the present invention may include driving means integrally mounted on carriage 2 to propel carriage 2 about the concrete structure. Also envisioned is an independent driving means such as a tractor or second carriage preceding or following carriage 2 to propel the carriage. Hereinafter, the preferred embodiment in accordance with the present invention will be described as having a driving means integrally mounted on carriage 2.

Figure 4:
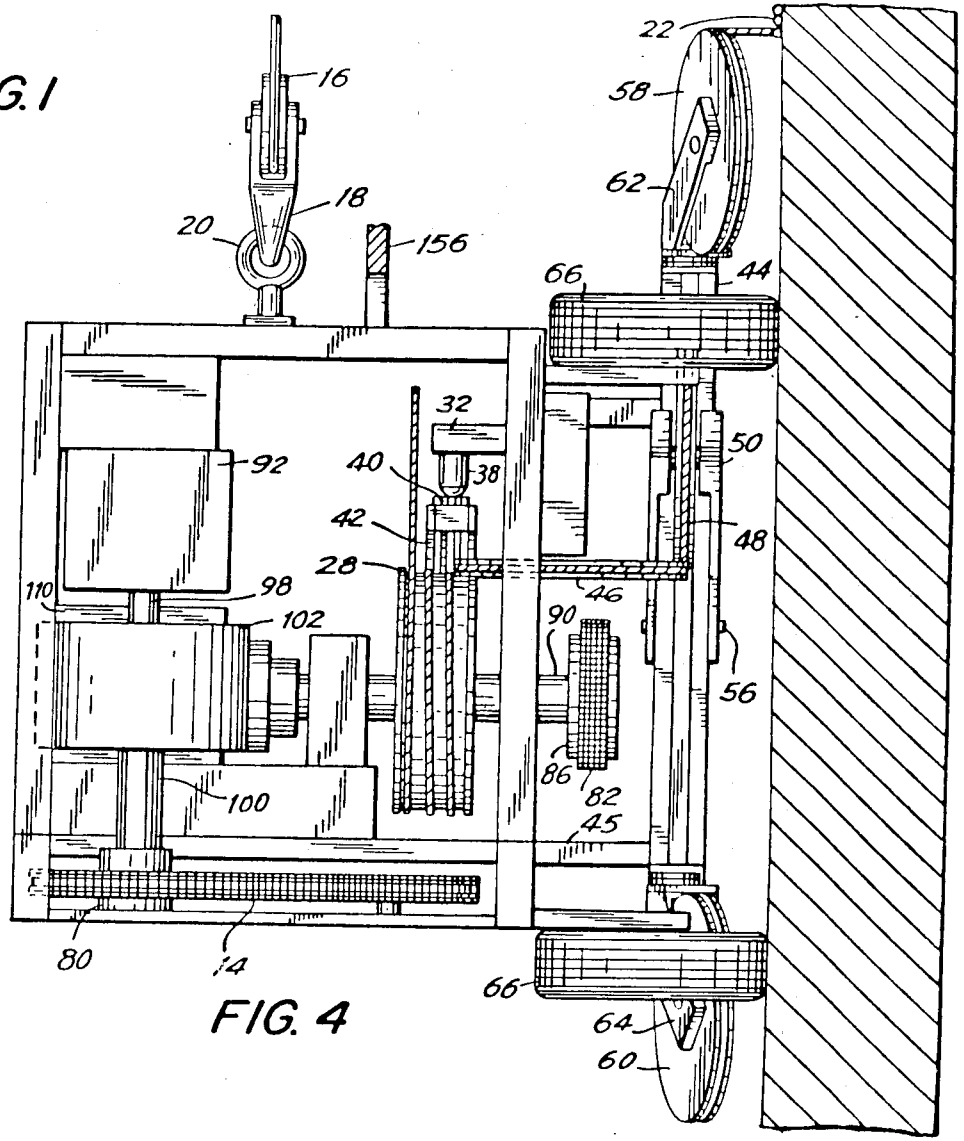
FIG. 4 is a cross-sectional view of the prestressing device taken along lines 4—4 of FIG. 2.
Figure 2:
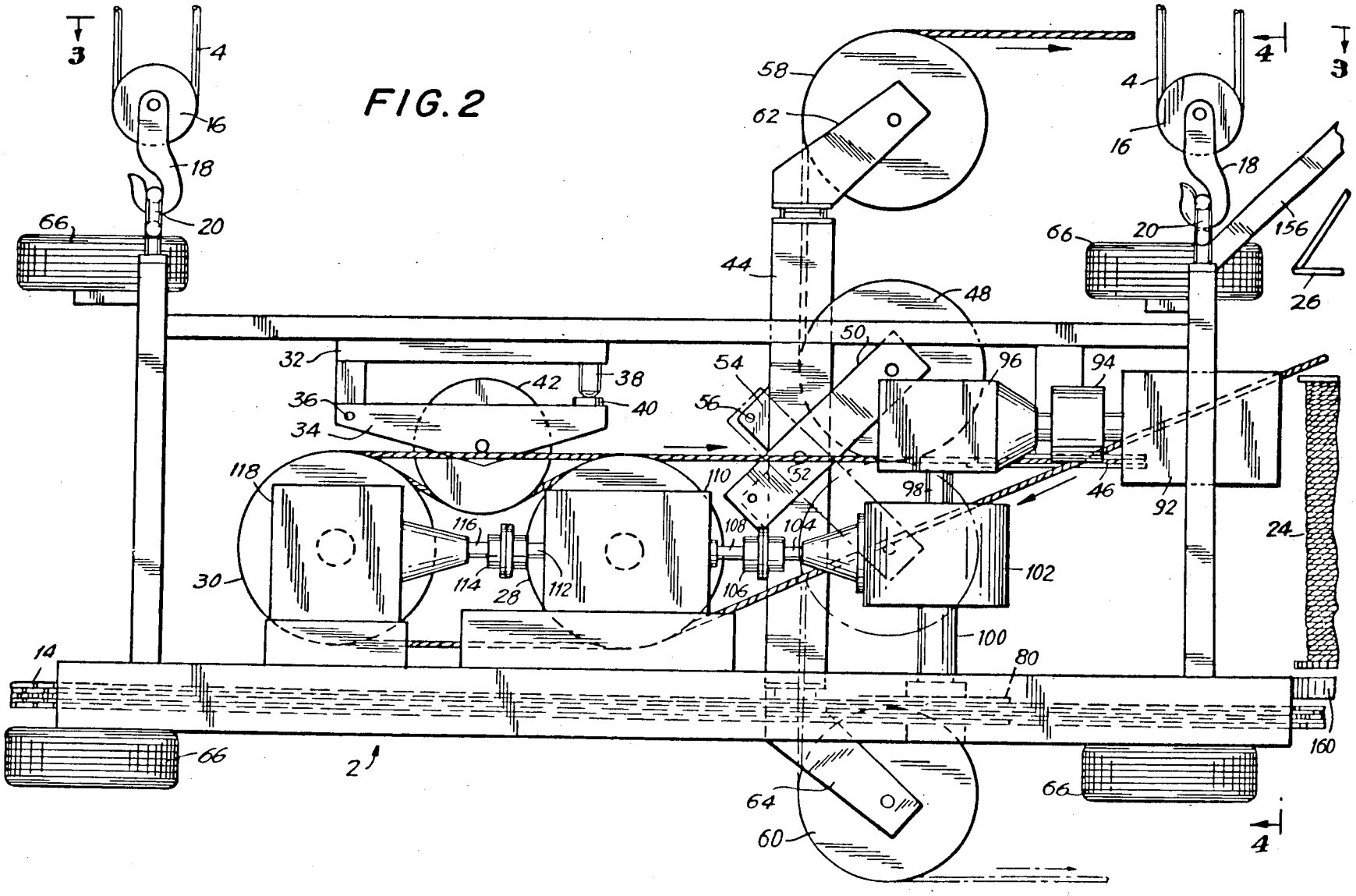
FIG. 2 is a cross-sectional view of the prestressing device in accordance with the present invention taken along lines 2—2 of FIG. 1.
Figure 3:
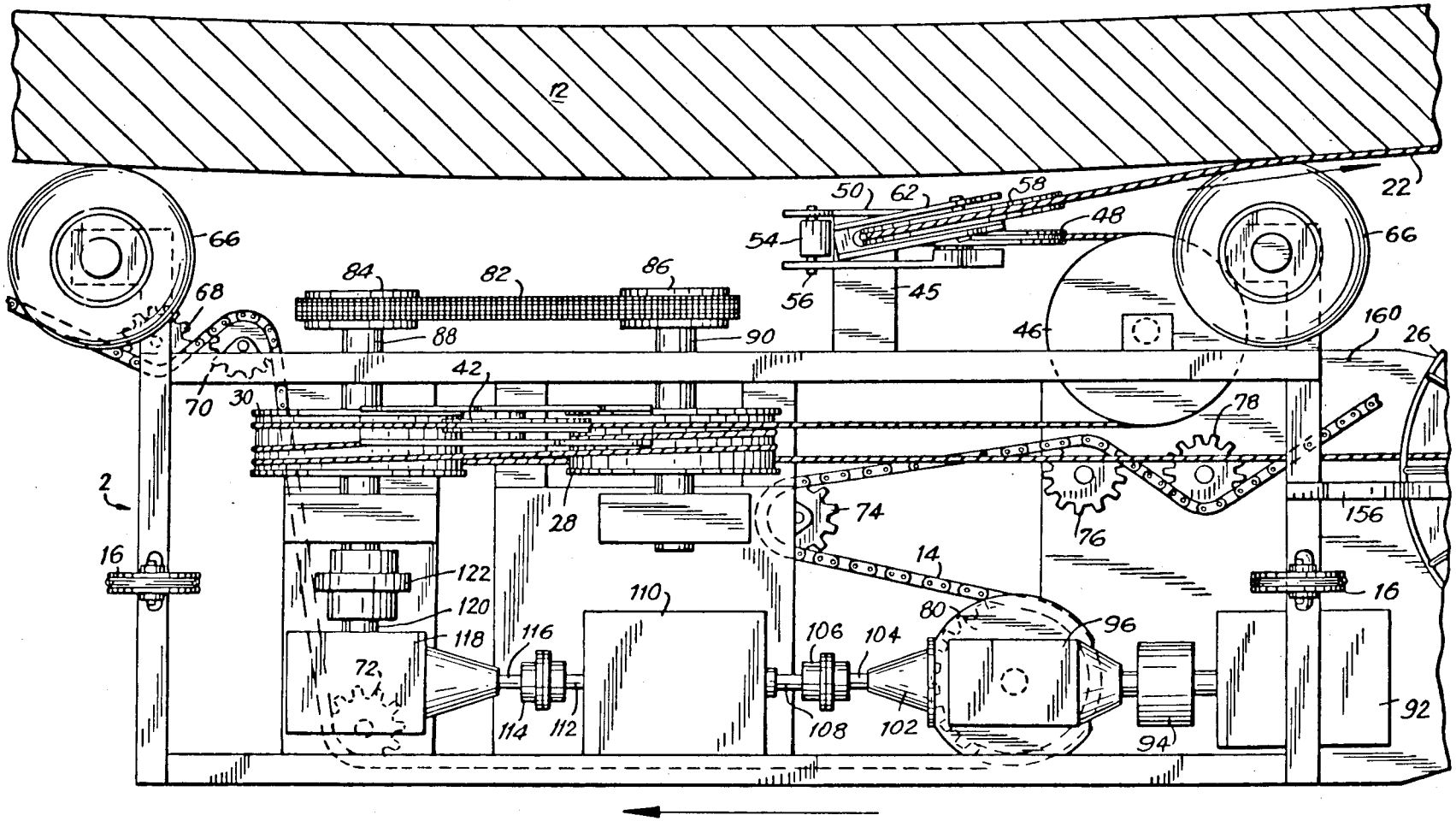
FIG. 3 is a cross-sectional view of the prestressing device taken along lines 3—3 of FIG. 2.

Referring now to FIGS. 2-4, untensioned wire is unwrapped from a wire supply 24 (partially shown) by wire supply payoff means 26 (partially shown) and either passes directly to first and second stress wheels 28 and 30 or may be guided to the stress wheels by a direction sheave (not shown) which deflects the wire as it is released by the payoff means 26.

The untensioned wire passes under first stress wheel 28 to the second stress wheel 30, partially encircles the second stress wheel and passes therefrom back to the first stress wheel 28. It then partially encircles first stress wheel 28 and is passed back to second stress wheel 30. This is repeated a number of times until sufficient friction between the wheel and the wire builds up so that the wire does not slip on stress wheels 28 and 30. The number of times the wire passes from stress wheel 28 to stress wheel 30 varies in accordance with the size of the stress wheels, the tension to be placed on the wire, the diameter of the wire and many other factors. A preferred number of passes about stress wheels 28 and 30 is between 4 and 12 with an optimal range between 6 and 8. Of course, the untensioned wire can pass either above or below stress wheels 28 and 30 on its first pass, as long as the other elements of the system are arranged to accommodate this. Untensioned wire is shown in the diagrams to pass below the stress wheels. The wire wraps around the two wheels together and does not fully encircle any one stress wheel. Such an arrangement prevents the wire from "walking."

The wire, on its last wrap around the stress wheels, as it exits stress wheel 30 and before it enters stress wheel 28, contacts the tensiometer 32. The tensiometer 32 includes a pivot bar 34 which pivots about bolt 36, a load cell 38, and a contact pad 40 mounted at one end of the pivot bar 34 which contacts the load cell 38. The tensiometer 32 also has rotatably mounted centrally on pivot bar 34 a center sheave 42. The center sheave contacts the wire which, now under tension after having been wrapped around stress wheels 28 and 30 several times, exerts a force on center sheave 42 and forces contact pad 40 to contact load cell 38 with a measurable force. The force exerted on load cell 38 is proportional to the tension in the wire before it is paid off from the prestressing device onto the wall of the concrete structure being wrapped. The force exerted on load cell 38 which measures the tension in the wire is recorded on a recording means (not shown) or may be used to automatically control the tension in the wire by use of a solenoid system or the like, as is further described herein. Center sheave 42 of the tensiometer 32 should be positioned in relation to stress wheels 28 and 30 so that the wire, on its last wrap around the stress wheels, is slightly deflected. As shown in FIG. 2, center sheave 42 is disposed between and slightly above stress wheels 28 and 30. After exiting the center sheave 42 of the tensiometer 32, the wire contacts stress wheel 28 and exits therefrom. The tensioned wire is now directed to a tensioned wire payout device.

The payout device includes a vertically disposed post 44 which is adjustably mounted on carriage 2 by carriage extension 46. The means for adjusting the height of the vertical post may include two C brackets (not shown) between which the vertical post 44 passes and a bolt (not shown) which passes through the ends of the C brackets so that the C brackets may be tightened together and wedge the vertical post at the desired height. The C brackets and end bolt may comprise a part of carriage extension 45 or may be situated elsewhere. Other means of adjusting the height of vertical post 44 are envisioned, such as, a mounting bracket which surrounds the vertical post as it passes through the floor of the carriage 2 with a locking set screw which passes through the mounting bracket and contacts the vertical post 44 with sufficient pressure to keep it at its selected height.

A horizontally disposed direction sheave 46 is mounted either to the vertical post 44 or to the carriage 2. The tensioned wire, as it passes from stress wheel 28 after its last wrap, is directed to direction sheave 46 which changes its direction and feeds it to center sheave 48 adjustably mounted on the vertical post 44. Center sheave 48 is vertically disposed and mounts to vertical post 44 by bracket 50. Bracket 50 is affixed to vertical post 44 by pin 52 which passes through vertical post 44. One end of bracket 50 includes a triangular shaped wedge 54 which is pinned by pin 56 to the bracket. One side of wedge 54, preferably the longer or hypotenuse side of the triangular shaped wedge, contacts a side of vertical post 44. The interaction of wedge 54 and pin 52 allows bracket 50 to be placed in a position either above direction sheave 46 or below the same. In other words, the tensioned wire, as it exits direction sheave 46, will contact either the top or bottom of center sheave 48.

Disposed at the upper and lower ends of vertical post 44 are upper and lower wire payoff sheaves 58 and 60 respectively. The upper and lower payoff sheaves 58 and 60 are mounted respectively to upper and lower brackets 62 and 64 which, in turn, are rotatably mounted to the ends of vertical post 44. In this way, the tensioned wire can be paid off from the upper or lower payoff sheaves 58 and 60 at an angle which is tangential to the wall of the concrete structure.

Depending on whether the concrete structure is to be wrapped above or below the relative height of the carriage in relation to the wall of the concrete structure, the tensioned wire will be directed partially around direction sheave 46, partially around center sheave 48 and directed to either the upper wire payoff sheave 58 or the lower wire payoff sheave 60.

The vertical post 44 may be hollow so that the wire from center sheave 48 passes through the post to either the upper payoff sheave 58 or the lower payoff sheave 60.

The carriage also has mounted thereon wheels 66 which contact the wall of the concrete structure, and sprocket gears 68, 70, 72, 74, 76 and 78, which engage the drive chain 14. Also rotatably mounted on carriage 2 is drive sprocket 80 which also engages the drive chain 14.

Stress wheels 28 and 30 are joined together by a governor chain 82 which engages sprockets 84 and 86 respectively connected to stress wheels 30 and 28 via shafts 88 and 90. Both stress wheels 30 and 28 are driven at the same rate because of interconnecting chain 82.

Also preferably mounted on carriage 2 is driving motor 92 which is coupled through coupler 94 to a right angle gearbox 96. Right angle gearbox 96 has an output shaft 98 which is connected to shaft 100 on which drive sprocket 80 is mounted. Shafts 98 and 100 are connected to gearbox 102 which has an output shaft 104 which rotates at a proportionately increased speed when compared to that of drive sprocket shaft 100. Output shaft 104 of gearbox 102 is coupled via coupler 106 to an output shaft 108 of slip clutch 110. Input shaft 112 of slip clutch 110 is connected via coupler 114 to input shaft 116 of speed-reducing gearbox 118. Output shaft 120 of speed-reducing gearbox 118 is coupled via coupler 122 to stress wheel shaft 88. Speed reducing gearbox 118 results in an increased rotational speed of output shaft 112 of slip clutch 110. Because a similar situation is provided by gearbox 102 to the output shaft 108 of the slip clutch, the frictional forces developed in the slip clutch are maintained in the dynamic range and thus more accurately controlled.

The driving force which propels the carriage 2 about the periphery of the concrete structure is a combination of the tension on the wire and the motor. Most of the driving force is generated by the tension in the wire. Therefore, power requirements are minimized through this "energy conservation" effect. Torque produced by the stress in the tensioned wire is transmitted through the slip clutch 110 to gearbox 102 and drive sprocket shaft 100. This torque is supplemented by driving motor 92 through right angle gearbox 96 and its associated coupling shaft 98.

Figure 2A:
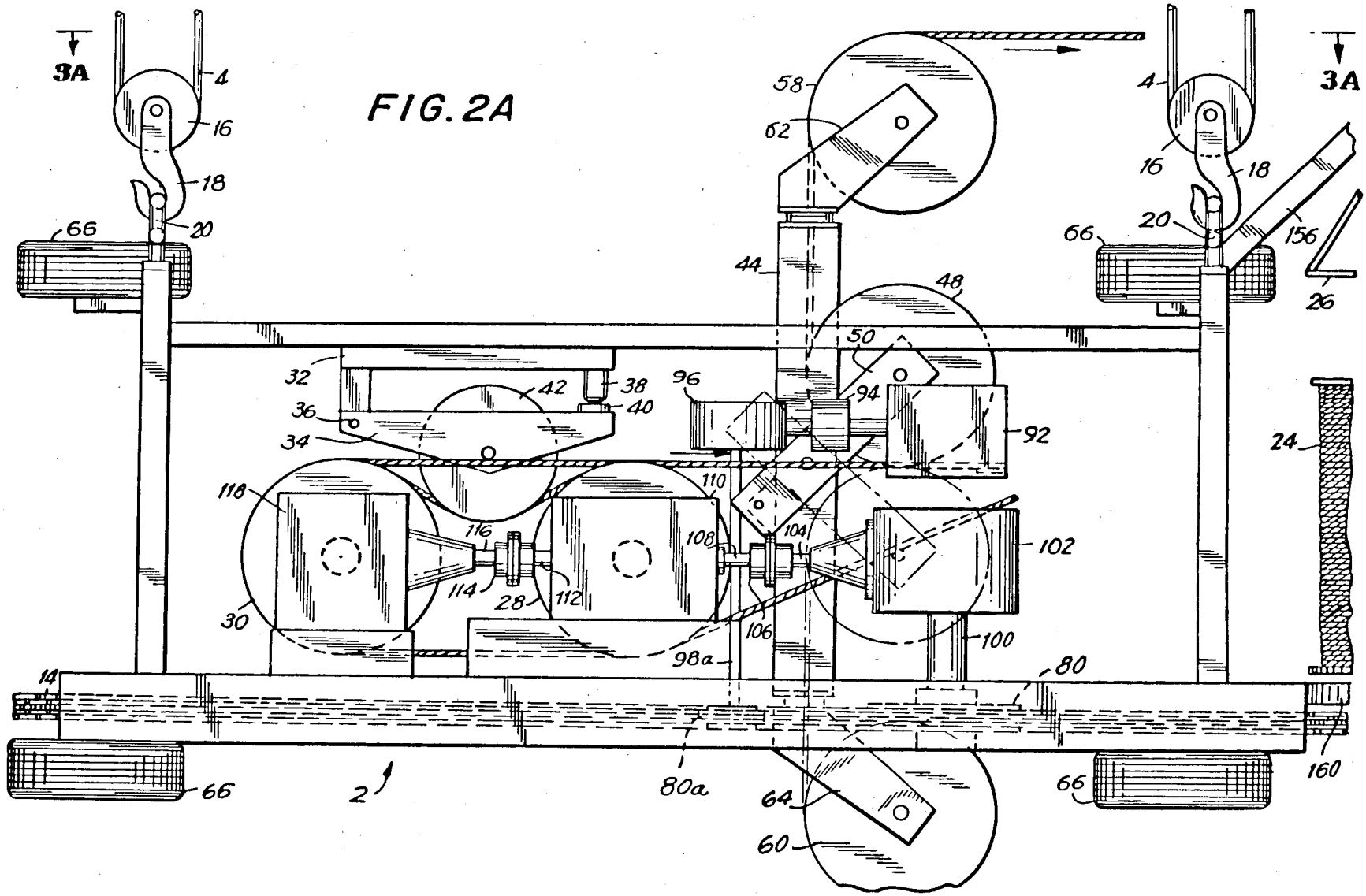
FIG. 2A is a cross-sectional view of an alternative embodiment of the present invention.
Figure 3A:
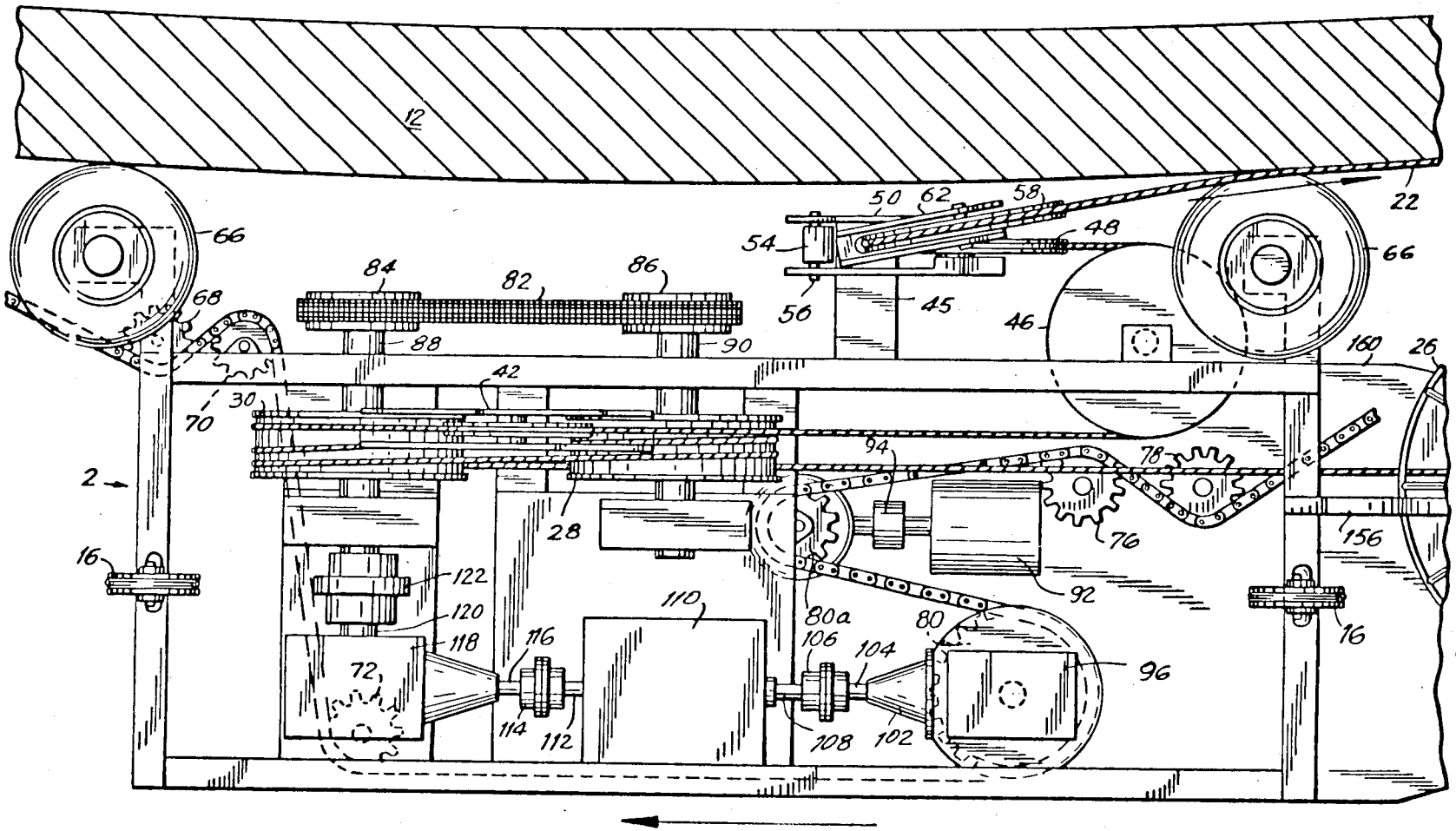
FIG. 3A is a cross-sectional view of the embodiment shown in FIG. 2A taken along lines 3A—3A of FIG. 2A.

In an alternative arrangement, a separate drive sprocket **80*a* may be employed, as illustrated in FIGS. 2A and 3A, to supplement the driving force generated by the tension in the wire. The prestressing device shown in FIGS. 2 and 3 may be modified by eliminating shaft 98 which interconnects the motor driven right angle gearbox 96 and gearbox 102. As shown in FIGS. 2A and 3A, shaft 98*a* is included and links gearbox 96 with the additional drive sprocket 80*a*. Drive sprockets 80 and 80*a* engage drive chain 14 to propel the prestressing device around the concrete structure. Drive sprocket 80 in this alternative embodiment is mechanically linked to the stress wheels in the same manner as described for the embodiment illustrated in FIGS. 2 and 3. Furthermore, the diameter of drive sprocket 80** remains the same when used in either embodiment.

It is advantageous for several reasons to have two separate drive sprockets, one being linked to the stress wheels and the other being driven by the motor. Many drive motors available on the market produce a high rotational speed and low torque at their output shafts. To accommodate these drive motors, drive sprocket 80*a* is used and is selected with a relatively small diameter.

Shown in FIG. 5 is a wire supply payoff device in accordance with one embodiment of the present invention. A supply of wire 24, preferably a wire spool, is placed on a spindle section which includes vertical spindle posts 124, which are joined to each other at their tops, and a bonnet 126 which is a horizontally disposed circular ring connected via brackets (not shown) or the like to the upper portion of vertical spindle posts 124. Disposed vertically above the spindle section of the wire supply payoff means is a conically shaped basket 128. Preferably, basket 128 comprises a lower horizontally disposed circular ring 130, which is approximately the same size as bonnet 126 and which defines an inlet opening 131 to receive the wire from the wire supply, and support members 132 attached to lower basket ring 130 and which converge to define a wire outlet opening 133 smaller in diameter than the inlet opening 131 and attach to killer wheel assembly 134. The basket may also include cross supports 136 attached transversely to supports 132. Untensioned wire is vertically unwound from wire supply 24, is passed on the outside of bonnet 126 and enters basket 128 whereupon it enters killer wheel assembly 134.

Shown in FIGS. 6, 7 and 8 are detailed drawings of the killer wheel assembly 134. The killer wheel assembly includes an entrance guide die 136, an exit guide die 138 and three killer wheels, which include two outer killer wheels 140 and a center killer wheel 142. Center killer wheel 142 is adjustably mounted in relation to the outer killer wheels 140 so that the wire is slightly deflected as it passes between killer wheels 140 and 142. Such action removes any bends or kinks in the wire as it unwraps from the spool and enters basket 128. Killer wheels 142 and 140 also provide an adjustable back tension to the wire.

The killer wheels 140, 142, basically include a V- or U-shaped inner section 144 on which the wire rides, interposed between two outer sections 146 having diameters which are greater than that of the inner section 144.

As shown in FIG. 5, the wire passes out of killer wheel assembly 134 through exit guide die 138 and over sheave 148. Attached to sheave 148 is a spring 150 and sensing device 152 which automatically stops movement of the carriage or payout of the wire when wire tangle, kink, or the like causes a certain downward deflection of sheave 148.

Figure 9:
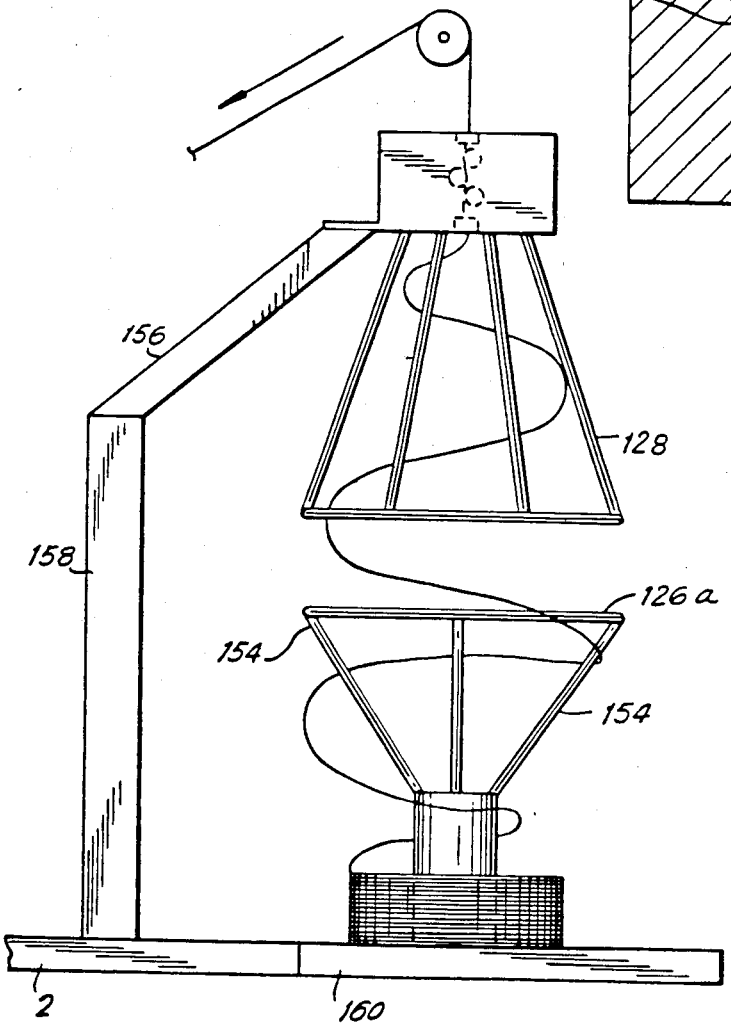
FIG. 9 is an elevation view of a wire supply payoff device in accordance with another embodiment of the present invention.

Shown in FIG. 9 is another embodiment of the wire supply payoff means in accordance with the present invention. Bonnet 126A of the spindle section of the payoff means includes angularly disposed brackets 154 which aid in guiding the wire from the wire supply around bonnet 126A into basket 128. Basket 128 is supported by support member 156, a portion of which is angularly disposed and attached to framework 158 of carriage 2. The spindle section of the wire payoff means may be mounted on an extension 160 of the carriage 2.

Figure 12:
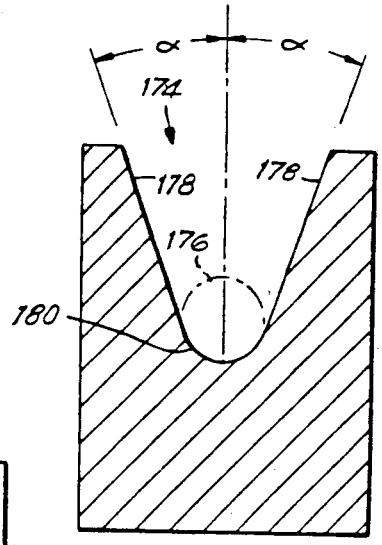
FIG. 12 is a detailed sectional view of a portion of one of the stress wheels shown in FIG. 12.
Figure 11:
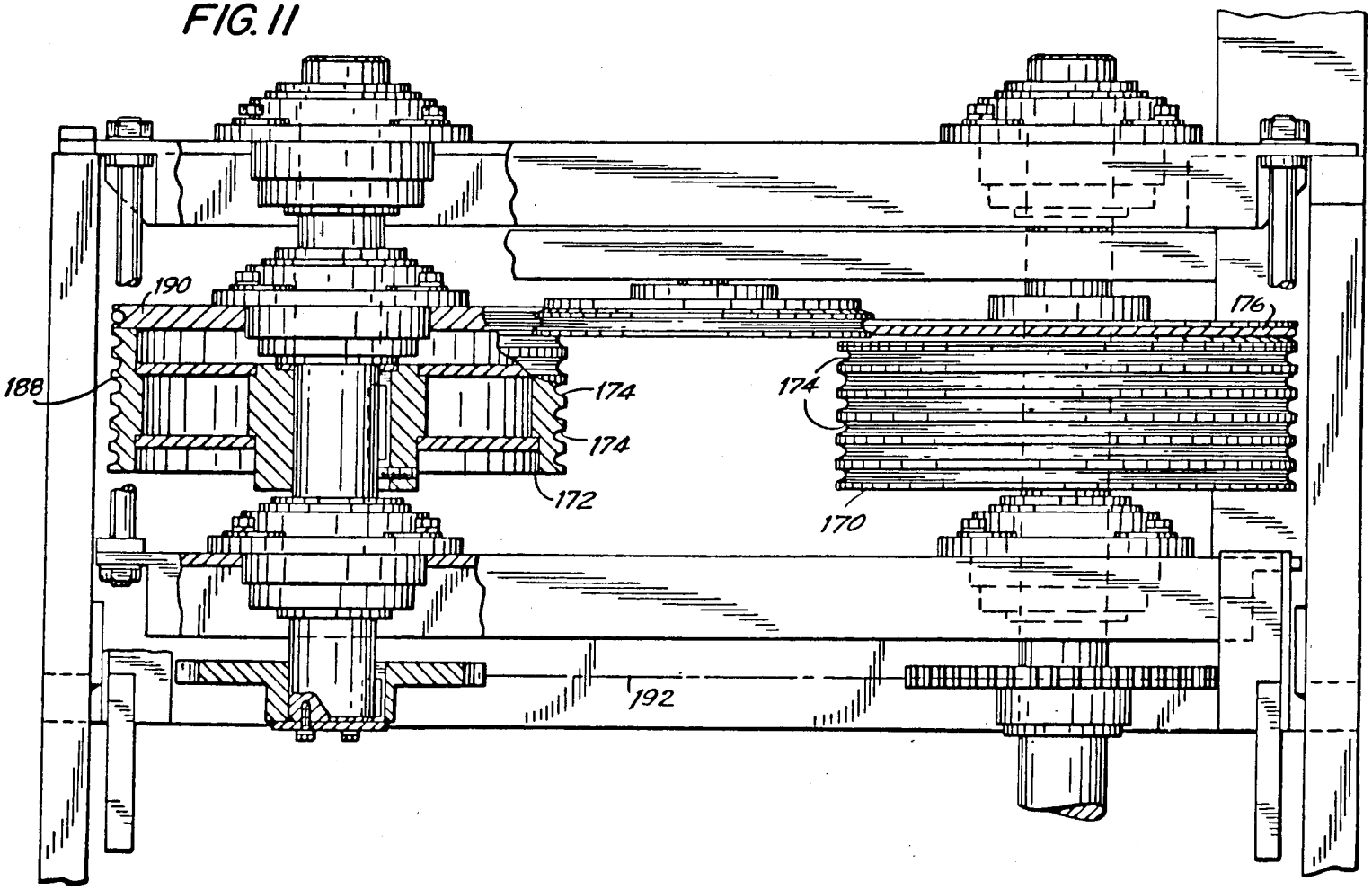
FIG. 11 is a sectional view of the embodiment shown in FIG. 10 taken along lines 11—11 of FIG. 10.
Figure 13:
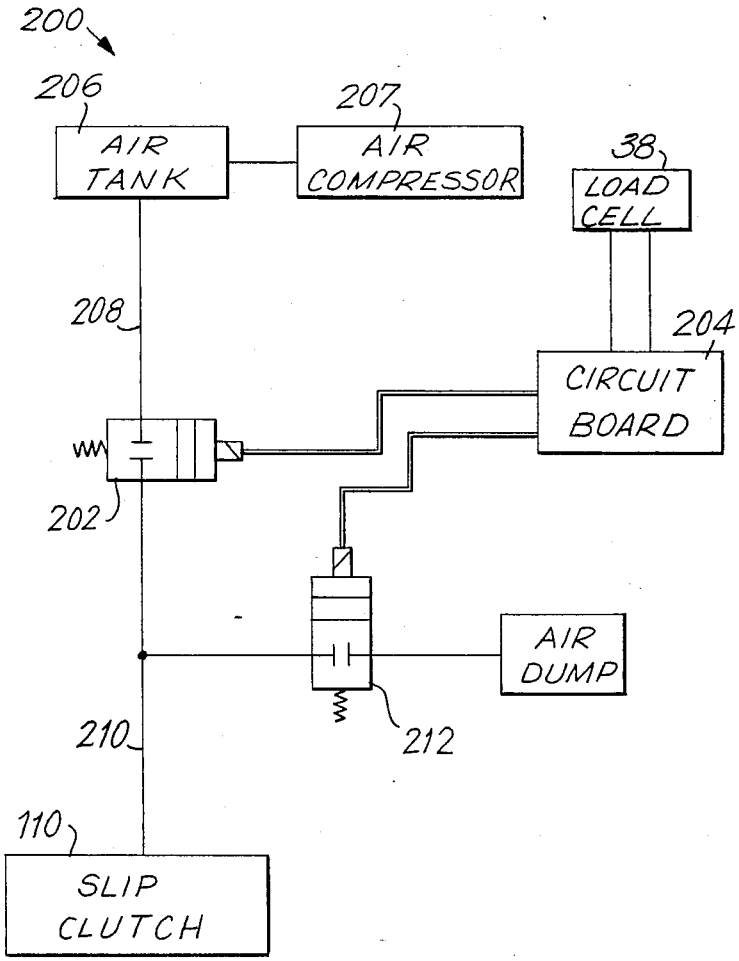
FIG. 13 is a detailed schematic of the device of the present invention which automatically adjusts the tension in the prestressed wire.

Illustrated in FIGS. 11 and 12 of the drawings are a pair of first and second stress wheels, 170 and 172 respectively, which are similar in many respects to the stress wheels 28, 30 shown in FIGS. 2–4. Although not necessary in a two-wheel system, the stress wheels 170 and 172 may have formed in the circumferential surfaces thereof grooves 174 to seat the wire 176 which partially encircles each wheel.

A typical groove 174 is shown in detail in FIG. 12 of the drawings. The groove is defined by walls 178 of the wheel and rounded bottom portion 180. The walls 178 are mutually divergent and form an angle with the plane of symmetry, shown as a broken line in FIG. 12, of about 30° . This particular angle is chosen to facilitate the transfer of the wire 176 from one stress wheel to the other. It also eliminates the wear on the walls 178 defining the groove caused by the wire 176, and prevents the wire splice from wedging itself into the groove, as discussed later. The radius of the rounded bottom portion 180 is chosen to at least equal the radius of the wire 176 used in wrapping the concrete tank. Although wires of radii less than the radius of the rounded portion may be used and are preferably used, the use of wires of radii greater than that of the rounded portion should be avoided. This is to prevent the wire's wedging between the walls 178 defining the groove 174. Wedging could cause deformation to the cross-sectional shape of the wire which is an undesirable feature for basically two reasons—the strength of the wire may be weakened and greater force is needed to remove the wire from the groove in which it is wedged, leading to greater variations in the final tension of the wire.

As mentioned earlier, the two-wheel system of the present invention allows splices to be incorporated into the wire before it is stressed, i.e., before it wraps around the stress wheels. This is a highly advantageous feature of the invention because it is much easier to splice the unstressed wire than it is to splice stressed wire and there is, of course, no affect on the final tension of the wire. Therefore, the grooves 174 formed in the stress wheels should be dimensioned to accommodate the splice without the splice becoming deformed in shape or loosened. Partially for this reason, the angle each of the walls of the grooves forms with the plane of symmetry is selected to prevent the wire splice from wedging itself into the grooves.

Figure 10:
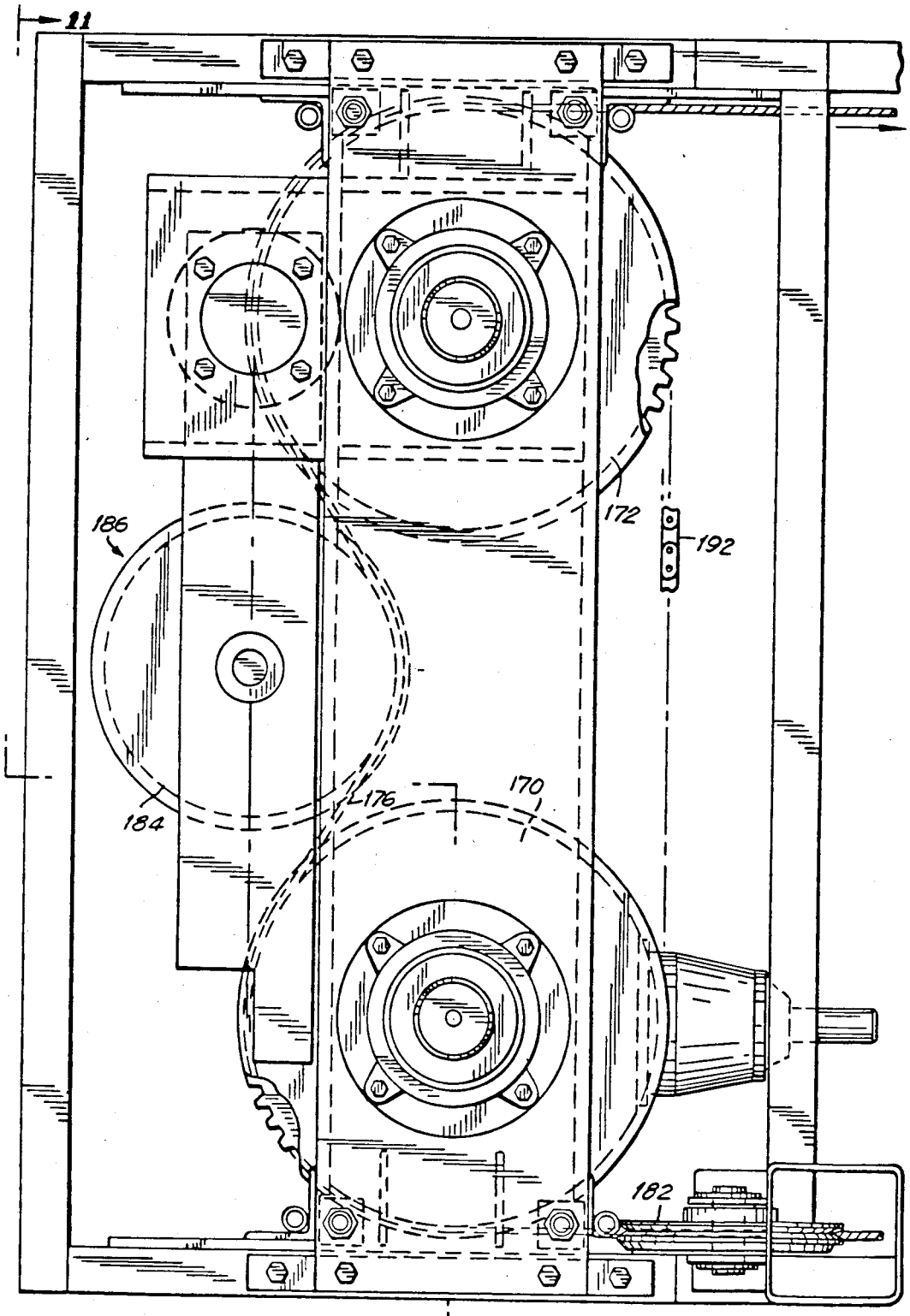
FIG. 10 is a plan view of a portion of an alternative embodiment of the prestressing device of the present system.

If the stress wheels are grooved, as shown in FIGS. 10 and 11 of the drawings, the grooves 174 of one wheel are offset from those of the other wheel by about one-half the width of a groove. This again is to facilitate transfer of the wire 176 from one wheel to the next and to minimize wear on the walls 178 defining the groove.

In theory, to prevent the wire from slipping or unraveling from the stress wheels, a certain amount of back tension must be provided to the wire before it enters the stress wheels. This back tension can easily be provided by the wire supply payoff means 26 and, in particular, by adjusting the distance the killer wheels 140, 142 of the payoff means are offset from each other. The back tension can be calculated from the following equation:

$$B = F \times e^{-u\theta} \qquad \text{(Equation 1)}$$

where

B equals the back tension exerted on the unstressed wire;

F equals the desired tensile stress of the wire being wrapped onto the concrete structure;

u equals the coefficient of friction between the wire and the stress wheels; and $\theta$ is an angular measurement, expressed in radians, of the portion of the circumference of each stress wheel which the wire contacts multiplied by the number of wheels and the number of times the wire is partially wrapped around each wheel.

An example is shown below for calculating the theoretical back tension required for a 0.162 inch diameter wire which is commonly used today in wrapping concrete structures. Typically, $\mu$ equals about 0.2 to 0.4, but this, of course, may vary from embodiment to embodiment. To tension a 0.162 inch diameter to about 3100 pounds, which, as will be explained later, should not be exceeded for a wire of this size, and wrapping the wire around the two stress wheels a total of 7 times, the necessary back tension which must be provided to the unstressed wire can be calculated from Equation 1 as follows:

$$B=F\times e^{-u\theta}$$
$$B=3100\times e^{-.2(\pi\times 2\times 7)}$$
$$B=3100\times e^{-8.79}$$
$$B=89 \text{ lbs.}$$

In effect, it can be seen that by wrapping a wire several times around the stress wheels, the tension exerted on the wire by the wire payoff means 26 is amplified to provide the wire with the desired stress before it is applied to the tank wall. The affect of each wrap around the stress wheels on the tension in the wire diminishes exponentially to a point where it has a negligible affect on the final tension. This typically occurs after seven or eight wraps.

As briefly mentioned before, there is a limit to the stress which can be applied to a wire of given diameter. Typically, a 0.162 inch diameter wire is rated at a tensile strength of 210,000 psi. To determine the amount of stress which safely can be applied to the wire, the tensile strength of the wire is multiplied by its cross-sectional area and, for safety, the wire is stressed to 70% of this value. Wire having a diameter of 0.162 inches can be typically safely stressed to between 3,000 and 3,100 lbs.

In practice, the amount of back pressure required may be less than the theoretical value. Of course, if spring steel cable is being used to wrap the tank, more back pressure may be required than with other types of cables to keep the cable from unraveling from the stress wheels .

As with many prior art prestressing devices, the wire to be wrapped around the structure is elongated by feeding out less wire than the distance travelled by the device around the periphery of the structure. A differential drive mechanism is generally employed in such devices so that the energy of the tensioned wire is advantageously used to help propel the device around the concrete structure.

The work expended by the device in wrapping the wire thus becomes:

$$W=F\times\Delta L$$

where

F equals the force needed to drive the device around the structure for a given distance L; and $\Delta L$ equals the incremental change in the length of the wire, elongated under tension.

It is commonly known that to prestress steel wire to 150,000 lbs./sq. in., which is a typical value for most wrapping operations, it is necessary to elongate the wire to an additional 0.006 of its original, unstressed length. To facilitate an understanding of this invention the value 0.006 will be used hereinafter in describing the selection of the various components of the prestressing device.

One way of wrapping the tank with prestressed wire is to have a drive sprocket, such as that designated by reference numeral 80, which meshes with the drive chain 14 encircling the structure, ganged with one or more stress wheels or sheaves around which the wire travels so that both rotate in unison. The diameter of the stress wheel may be made to be 0.994 that of the drive sprocket so that the 0.006 difference in wire elongation is realized. In many applications this approach has proven to be impractical due to many factors which affect the ratio of the diameters of the stress wheel and drive sprocket, such as for example, wear in the wheel.

In accordance with the present invention, it has proven to be advantageous to overstress the wire by reducing the ratio of the diameters of the stress wheels and drive sprocket 80 from the theoretical value of 0.994 to 0.9 or 0.95, for example, and to employ in the differential drive mechanism a slip clutch 110 which is selected to slip when a predetermined torque is exceeded. Both constant and controllably variable slippage applications are envisioned as being feasible. With the system of the present invention, there is, of course, a small additional expenditure of energy which is equal to heat loss due to the clutch slippage, but by choosing the components of the system carefully, this energy loss can be minimized.

For example, in one preferred embodiment of the present invention, the diameter of each stress wheel was chosen to be 18 inches. Thus, theoretically the drive sprocket 80 must be at least 18 inches divided by 0.994, or 18.10 inches. To overstress the wire, a drive sprocket of 19.112 inches was chosen so that the ratio of the diameter of the drive sprocket to those of the stress wheels was 0.942. Therefore, to get back to the ratio of 0.994 from the preferred ratio of 0.942, or stated another way, to obtain the desired stress in the wire, that is, to elongate the wire by 0.006 of its initial length, a slip clutch 110 is employed which is selected to disengage at a 5% rate.

Many suitable slip clutches are available on the market today. An example of one such clutch is Posidyne Clutch Model No. 10-C, manufactured by Force Control Industries, Inc. of Fairfield, Ohio. Model No. 10-C is an oil shear clutch, which is preferred, but conventional friction plate clutches may be suitably used. This clutch disengages at different, selectable torque values so that more or less stress may be applied to the wire as desired.

Ideally, the drive sprocket and the stress wheels may be directly connected by their respective shafts to the input and output ends of the slip clutch but, as mentioned earlier, there are certain disadvantages to doing this. In practice, the stress wheels and associated shaft 88 rotate at a relatively low speed, for example, 100 RPM. A clutch providing a constant 5% slippage would thus cause the drive sprocket 80 and shaft 88 to rotate at 95 RPM. The difference between the speeds at which the ends of the slip clutch rotate is only 5 RPM, which is at the low end of the clutch's usable range. The clutch, working at this speed, may be affected internally by static coefficients of friction and may "chatter" or slip uncontrollably and inconsistently, causing variations in the rotational speed of the drive sprocket and thus affecting the tension placed on the wire. Therefore, it is desirable to keep the clutch operating within its dynamic range.

To accomplish this, gear boxes 118, 102 are interposed between the input and output ends of the clutch 110 and the drive sprocket and stress wheels, as shown in FIG. 3 of the drawings. Gear box 118 steps up the revolutions of the stress wheel shaft 88 into the input end of the slip clutch by a predetermined ratio and, of course, reduces the torque on the clutch by the same ratio. The other gear box 102 converts the rotational speed of the output end of the clutch to a lower speed on drive sprocket shaft 88 by the same ratio selected for gear box 118 or by a different ratio, although with a different ratio, less power transfer and greater energy loss through heat generated by clutch slippage may result.

The following is an example of the mechanism described above illustrating the transfer of energy from the stress wheels to the drive sprocket to help drive the prestressing device about the structure being wrapped.

The stress wheels, as mentioned earlier, rotate at about 100 RPM and generate about 27,000 inch pounds of torque in the stress wheel shaft 88, without considering other secondary losses. Gear box 118 is selected with a gear ratio of 1:4.56. Thus, the gear box 118 increases the rotational speed of the input shaft 112 of the slip clutch to 456 RPM and reduces the torque which the slip clutch sees to 27,000 inch pounds divided by 4.56, or 5921 inch pounds. The clutch 110, slipping at a 5% rate, causes the output shaft 108 of the clutch to rotate at 433 RPM. The second gear box is selected with a 4.56:1 ratio and reduces the rotational speed of the drive sprocket 80 to 95 RPM. With the gear boxes in the system's circuit, the rotational speed of the input shaft of the slip clutch is well within the dynamic range of the clutch. This minimizes the static, frictional effects of the internal components of the clutch. The gear boxes 102, 118 also advantageously reduce torque load on the clutch. A smaller clutch may now be selected because it need only be capable of handling 5921 inch pounds of torque.

An alternative embodiment of the prestressing device of the present invention is illustrated in FIGS. 10 and 11 of the drawings. The embodiment shown in FIGS. 10 and 11 basically differs in three ways from that shown in FIGS. 2–4 and previously discussed—the stress wheels rest on their sides and rotate in a horizontal plane, the wheels are grooved with the grooves of one wheel being offset from those of the other, and a section of one of the wheels, which receives the wire after it contacts the tensiometer's center sheave, is free spinning.

Because of space constraints, it may be advantageous to relocate on the platform some of the components which make up the system. With the embodiment shown in FIGS. 10 and 11, the stress wheels have been positioned crosswise on the platform and, so that they take up as little vertical space as possible, have been placed on their sides so that they rotate in a horizontal plane. This allows the components of the system to be arranged in two tiers above the floor of the platform without the prestressing device becoming restrictive in height.

The structure of the tensiometer 186 remains the same as that previously discussed with the embodiment illustrated in FIGS. 2–4 and has its center sheave 184 disposed between but partially out of line with the two stress wheels.

As shown in FIG. 10, the wire 176 is directed to the first stress wheel 170 from the wire supply payoff means, such as 26 through a vertical direction sheave similar to the direction sheave disclosed in connection with the embodiment shown in FIG. 4. The wire then wraps around the first stress wheel 170 and the second stress wheel 172 a number of times. On its last wrap, the wire passes under the center sheave 184 of the tensiometer 186 which, because of its position, deflects the wire as it passes between the first and second stress wheels 170, 172. As mentioned earlier with the previous embodiment illustrated in FIGS. 2–4, the pressure exerted by the wire 176 on the center sheave 184 is transferred to a load cell which, in turn, is connected to a recording or other monitoring device for measuring the stress placed on the wire.

In the embodiment illustrated in FIGS. 2–4, the wire, on its last wrap around the stress wheels 28, 30, contacts the second stress wheel only over about 15% of its circumference. The tension in the wire by its contact with the first wheel on the last wrap is negligible. For this reason, the tensiometer, although positioned to contact the wire before it wraps partially around the second stress wheel 30 on the last wrap, accurately measures the tension in the wire placed on the concrete structure.

With the embodiment shown in FIGS. 10 and 11, the stress wheels are positioned crosswise to the platform and the wire is fed from the second stress wheel 172 to a tensioned wire payoff device, such as vertical post 44 shown in FIGS. 2–4, in a direction lengthwise to the platform. Thus, the wire on its last wrap will contact the second stress wheel 172 over a substantial part of its circumference.

To ensure that the wire's contact with the second stress wheel 172 has no or little effect on the final tension in the wire so that the tensiometer 186 positioned between the two wheels accurately measures the stress in the wire as wrapped, the second stress wheel 172 may be divided into first and second pulleys 188 and 190, respectively. The first pulley 188 includes six of seven grooved surfaces and is driven in unison with the first stress wheel 170 through a governor chain 192. The second pulley 190 is a single grooved sheave which rotates freely on the second stress wheel's axle. It is not driven and not connected to either the first pulley 188 or the first stress wheel 170. Thus, it imparts no additional stress on the wire and rotates with movement of the wire as it is paid off from the prestressing device. Therefore, the tensiometer 186, even though interposed between the two stress wheels, still accurately measures the tension in the wire wrapped around the concrete structure.

Because the stress wheels of FIGS. 10 and 11 are on their sides as opposed to standing upright, as shown in FIGS. 2–4, the horizontally disposed direction sheave 46 which is interposed between the stress wheels and the payoff means can be eliminated.

In addition, the tension in the prestressing wire being applied to the concrete structure, so as to keep the tension within a small tolerance of a predetermined level, may be automatically and rapidly increased or decreased as a result of the present invention. Referring to FIGS. 2 through 4, an electronic device 200 monitors the voltage signal produced by the load cell 38. The level of the voltage signal produced by the load cell varies linearly with the amount of tension in the tensioned wire 22. When the desired tension is achieved in the prestressed wire, the level of the voltage signal through the electronic device at that particular tension is determined. The upper and lower voltage signals of this desired range can be pre-set within the voltage display of a mechanical recorder (not shown). For the purposes of example and not of limitation we will use as an example that this predetermined voltage signal is 1.0 volt.

The electronic device is pre-set such that a monitored voltage below the predetermined voltage (i.e. 1.0 volts) causes the electronic device to increase the air supply to the slip clutch 110. A monitored voltage above 1.0 causes a decrease in the air pressure to the slip clutch. Since the air pressure to the slip clutch is what determines the tension in the prestressing wire, the result is an automatic feed-back loop which results in the wire tension constantly being monitored and brought back to the desired tension.

The electronic device 200 of the present invention includes a first normally closed solenoid air pressure valve 202 which is electronically connected to a circuit board 204 which controls the opening of solenoid air pressure valve 202. An air supply means (i.e. air tank, etc.) 206 actuated by air compressor 207 is connected to first solenoid air pressure valve 202 by means of inlet air supply line 208. The first solenoid air pressure valve 202 is connected to the slip clutch 110 by means of exit air pressure line 210. When the monitored voltage falls below its predetermined voltage, the circuit board 204 transmits a signal opening solenoid air pressure valve 202 thereby permitting an increase in the air pressure to the slip clutch 110. As a result thereof, the amount of tension in the prestressed wire 22 is increased. When the tension in the wire is increased such that the monitored voltage falls within the predetermined range, the circuit board 204 ceases to transmit an open signal thereby causing the closing of solenoid air pressure valve 202.

A second normally closed solenoid air pressure valve 212 is electronically connected to circuit board 204 again controlling the operation of valve 212. The second solenoid air pressure valve 212 is connected to the slip clutch 110 by means of an exit air pressure line 210. When the monitored voltage goes above its predetermined voltage, the circuit board 204 transmits a signal opening second solenoid air pressure valve 212 thereby releasing or withdrawing air pressure from the slip clutch 110. As a result thereof, the amount of tension in the prestressed wire 22 is reduced. When the tension in the wire is reduced such that the monitored voltage falls within the predetermined range, the circuit board 204 ceases to transmit an open signal thereby causing the closing of solenoid air pressure valve 212.

As disclosed herein, the electronic device of the present invention provides for an automatic feed-back loop which results in the wire tension constantly being monitored and brought back with the predetermined range.

Although illustrative embodiments of the invention have been described herein with reference to the accompanying drawings, it is to be understood that the invention is not limited to those precise embodiments, and that various other changes and modifications may be effected therein by one skilled in the art wihtout departing from the scope or spirit of this invention.

What is claimed is:

1. A device for prestressing structures by wrapping tensioned wire around the periphery of the same, which comprises:

a carriage which travels about the periphery of the structure;

means for paying off wire from a wire supply, the wire supply payoff means being mounted to the carriage;

means for tensioning the wire supplied from the wire supply, the wire tensioning means including at least one pair of rotatable stress wheels each of which the wire at least partially encircles;

means for measuring the tension in the wire which produces an electrical output;

means for controlling the tension in the wire; and driving means to propel the carriage about the periphery of the structure, the driving means being mounted to the carriage and including a drive sprocket which is rotatably driven by the driving means and has a diameter which is greater than those of the stress wheels, the drive sprocket engaging a chain encircling the concrete structure to allow movement of the carriage about the periphery of the structure, wherein the wire tension control means includes a pneumatically actuated slip clutch having input shaft which is linked to one of the stress wheels and an output shaft which is linked to the drive sprocket of the driving means, the slip clutch being adjusted to slip when torque transferred from the tension in the wire is applied thereto and exceeds a predetermined torque value and means for increasing the rotational speed of the input shaft of the slip clutch proportionally to the rotational speed of the stress wheels, the speed increasing means being interposed between and connected to one of the stress wheels and the input shaft of the slip clutch wherein the input and output shafts of the slip clutch rotate at an increased speed, and wherein the wire tension control means includes a means to automatically regulate air pressure to the slip clutch such that the tension in the wire can be rapidly regulated.

2. A device for prestressing a structure as defined in claim 1 wherein the tension measuring means includes a rotatable center sheave disposed partially between two of the stress wheels so as to contact and partially deflect the wire passing from one of the two stress wheels to the other of the two stress wheels, the center sheave being displaceable relative to the position of the stress wheels in response to the pressure of the wire in contact with the center sheave, and means for measuring the pressure of the wire exerted on the center sheave, said pressure measuring means being connected to the center sheave, the pressure of the wire detected by the measuring means being proportional to the tension placed on the wire by the stress wheels.

3. A device for prestressing a structure as defined in claim 2 wherein the means for measuring the pressure of the wire exerted on the center sheave is a load cell.

4. A device for prestressing a structure as defined in claim 2 wherein the means to automatically regulate air pressure to the slip clutch is connected to the means for measuring the pressure of the wire exerted on the center sheave.

5. A device for prestressing a structure as defined in claim 1 wherein the means to automatically regulate air pressure to the slip clutch includes a means to increase the air pressure to the slip clutch so that the tension in the wire is automatically increased.

6. A device for prestressing a structure as defined in claim 5 wherein the means to increase air pressure to the slip clutch includes a circuit board which monitors a voltage signal produced by the means for measuring the pressure of the wire exerted on center sheave and is set to a predetermined range when the optimum tension in the wire is achieved.

7. A device for prestressing a structure as defined in claim 6 wherein the means to increase air pressure to the slip clutch includes a first solenoid air pressure valve being operatively connected to the circuit board, and also being operatively connected between an air supply means and the slip clutch such that when the first valve is opened, the air pressure in the slip clutch is increased.

8. A device for prestressing a structure as defined in claim 7 wherein the first solenoid air pressure valve is opened by an electrical response from the circuit board when the voltage signal is below the predetermined range.

9. A device for prestressing a structure as defined in claim 7 wherein the first solenoid air pressure valve is connected to the air supply means by means of a first inlet air pressure line.

10. A device for prestressing a structure as defined in claim 7 wherein the first solenoid air pressure valve is connected to the slip clutch by means of an exit air pressure line.

11. A device for prestressing a structure as defined in claim 1 wherein the means to automatically regulate air pressure to the slip clutch includes a means to decrease the air pressure to the slip clutch so that the tension in the wire is automatically reduced.

12. A device for prestressing a structure as defined in claim 11 wherein the means to decrease air pressure to the slip clutch includes a circuit board which monitors a voltage signal produced by the means for measuring the pressure of the wire exerted on center sheave, and is set to a predetermined range when the optimum tension in the wire is achieved.

13. A device for prestressing a structure as defined in claim 12 wherein the means to decrease air pressure to the slip clutch includes a solenoid air pressure valve being operatively connected to the circuit board such that when the voltage signal is above the predetermined range, the second valve is opened thereby reducing the air pressure in the slip clutch.

14. A device for prestressing a structure as defined in claim 13 wherein a solenoid air pressure valve is opened by an electrical response from the circuit board when the voltage signal is above the predetermined range.

15. A device for prestressing a structure as defined in claim 13 wherein the air pressure valve is connected to the slip clutch by means of an exit air pressure line.

16. A device for prestress in structures by wrapping tensioned wire around the periphery of the same, which comprises:

a carriage which travels about the periphery of the structure;

means for paying off wire from a wire supply, the wire supply payoff means being mounted to the carriage;

means for tensioning the wire supplied from the wire supply, the wire tensioning means including at least one pair of rotatable stress wheels each of which the wire at least partially encircles;

means for measuring the tension in the wire which produces an electrical output;

means for controlling the tension in the wire;

driving means to propel the carriage about the periphery of the structure, the driving means being mounted to the carriage and including a d rive sprocket which is rotatably driven by the driving means and has a diameter which is greater than those of the stress wheels, the drive sprocket engaging a chain encircling the concrete structure to allow movement of the carriage about the periphery of the structure, wherein the wire tension control means includes a pneumatically actuated slip clutch having an input shaft which is linked to one of the stress wheels and an output shaft which is linked to the drive sprocket of the driving means, the slip clutch being adjusted to slip when torque transferred from the tension in the wire is applied thereto and exceeds a predetermined torque value, and wherein the wire tension control means includes a means to automatically regulate air pressure to the slip clutch such that the tension in the wire can be rapidly regulated; and wherein the tension measuring means includes a rotatable center sheave disposed partially between two of stress wheels so as to contact and partially deflect the wire passing from one of the two stress wheels to the other of the two stress wheels, the center sheave being displaceable relative to the position of the stress wheels in response to the pressure of the wire in contact with the center sheave, and means for measuring the pressure of the wire exerted on the center sheave, said pressure measuring means being connected to the center sheave, the pressure of the wire detected by the measuring means being proportional to the tension placed on the wire by the stress wheels.

17. A device for prestressing a structure as defined in claim 16 wherein the means for measuring the pressure of the wire exerted on the center sheave is a load cell.

18. A device for prestressing a structure as defined in claim 16 wherein the means to automatically regulate air pressure to the slip clutch is connected to the means for measuring the pressure of the wire exerted on the center sheave.

* * * * *